United States Patent [19]

Chuan-Tien

[11] Patent Number: 5,009,418

[45] Date of Patent: Apr. 23, 1991

[54] TOY INCLUDING FISHING GAME AND PASSIVE GAME ELEMENTS

[76] Inventor: Chuang Chuan-Tien, No. 40, Lane 174, Ta Hsin Street, Tainan, Taiwan

[21] Appl. No.: 356,534

[22] Filed: May 25, 1989

[51] Int. Cl.[5] ..... A63F 9/00

[52] U.S. Cl. ..... 273/448; 273/454; 273/140

[58] Field of Search ..... 273/1 GE, 140, 1 GG, 273/1 GD, 1 GC

[56] References Cited

U.S. PATENT DOCUMENTS

| | | | |
|---|---|---|---|
| 1,708,472 | 4/1929 | Fulgora | 273/142 H |
| 4,603,860 | 8/1986 | Wey | 273/1 GD |
| 4,790,532 | 12/1988 | Chen | 273/1 GE |
| 4,834,373 | 5/1989 | Chaun-Tien | 273/1 GG |
| 4,838,553 | 6/1989 | Chaun-Tien | 273/1 GG |
| 4,861,026 | 8/1989 | Chaun-Tien | 273/1 GD |

FOREIGN PATENT DOCUMENTS

| | | | |
|---|---|---|---|
| 1186225 | 10/1985 | U.S.S.R. | 273/1 GG |

*Primary Examiner*—Benjamin Layno

*Attorney, Agent, or Firm*—Clifford A. Poff

[57] ABSTRACT

A toy including a fishing game and passive game elements. The fishing game allows the active participation of game participants, and the passive game elements provide visual enjoyment for the game participants. Both the fishing game portion and the passive game element portion rotate simultaneously through meshing engagement with a drive motor.

13 Claims, 6 Drawing Sheets

TOY INCLUDING FISHING GAME AND PASSIVE GAME ELEMENTS

BACKGROUND OF THE INVENTION

1. Field of the Invention

The present invention relates generally to fishing game toys, and, more particularly, to a fishing game toy comprised of a fishing game portion and passive game elements.

2. Description of the Prior Art

Fishing game toys for the entertainment of children are known in the art. Frequently such games include a plurality of game targets formed in the shape of fish with the plurality of game targets being supported on a game playing surface. Game participants attempt to catch the game targets with apparatus formed to imitate fishing rods. Each game target has a magnet affixed thereto, and the fishing rod includes a fishing line having a magnet connected to an end portion thereof to allow the game participants to catch the targets. To increase the skill required of the game participants to catch the game targets, fishing game toys have been developed in which the game targets are disposed on a rotatable pan which is supported to rotate upon a supportive housing. Means are provided, such as a drive motor, to rotate the rotatable pan.

In some prior art fishing game toys, the rotatable pan includes a plurality of sockets extending vertically through the pan, with the game targets being positioned therewithin. Vertical translation of the game targets is then provided by including on the supportive housing inclined tracks positioned beneath the game targets positioned in the sockets. By rotating the pan, the game targets are caused to travel up and down the inclined tracks during rotation of the pan.

To allow greater numbers of game participants to participate in the fishing game, some prior art fishing game toys further include a multiplicity of pans rotatably supported on the supportive housing wherein each of the pans is connected to rotate simultaneously. The game participants are then able to compete with one another to, for example, attempt to catch the greatest number of game targets during a certain period of time.

However, after a certain period of time, the skill level of the game participant increases such that the participants can easily catch the game targets. Oftentimes, interest in the use of the fishing game toy thereafter diminishes because the prior art fishing game toys are only inherently interesting for this one use.

It is, accordingly, the object of the present invention to provide an improved fishing game toy which visually entertains the game participants as well as providing a fishing game toy in which the skill required of the game participants is yet further increased.

SUMMARY OF THE INVENTION

In accordance with the present invention, a toy having a participant-interactive game portion for active interaction with game participants, and a noninteractive portion for visually entertaining the game participants is disclosed. The toy includes a supportive housing having a means forming a plurality of cavities on a support surface thereof, at least one participant-interactive game pan supported for rotation in a cavity of the means forming the plurality of cavities, passive game pieces supported for rotation about an axis of a shaft for visually entertaining the game participants, and drive means including a motor for simultaneously rotating the participant-interactive game pan and the passive game pieces. Preferably, the participant-interactive game pan includes a plurality of vertically extending sockets, and includes an annular peripheral surface having teeth formed thereon, wherein a plurality of game targets are positioned in the sockets of the pan for access thereto by the game participants.

In a first embodiment of the present invention, the passive game pieces are supported upon at least one noninteractive pan supported for rotation in a cavity of the means forming a plurality of cavities, wherein the noninteractive pan includes an annular peripheral surface having teeth formed thereon. The noninteractive pan may further include a plurality of vertically extending sockets to allow positioning of the passive game pieces therewithin. The toy may further include means supported by the support body for displacing individual ones of the game targets and/or passive game pieces in the sockets of the passive pan. In one embodiment of the present invention, the means includes wedge-shaped, inclined planes for causing the game targets to rise and fall in the sockets of the pans during rotation thereof. The plurality of sockets extending through the noninteractive pan may, for example, be rectangular. The drive means for simultaneously rotating the participant-interactive game pan and the noninteractive pan in the preferred embodiment engages with the teeth formed on the annular peripheral surfaces of the participant-interactive game pan and the noninteractive pan, respectively, for simultaneously rotating each of the pans.

In a further embodiment of the present invention, the toy further includes a sun gear and a plurality of cylindrical gears, wherein the sun gear is positioned coaxially with the noninteractive pan and the plurality of cylindrical gears are positioned at bottom portions of each of the plurality of passive game pieces for meshingly engaging with the sun gear such that rotation of the sun gear causes rotation of each of the plurality of passive game pieces about longitudinal axes thereof.

The shaft about which the passive game pieces are supported for rotation may, in one embodiment of the present invention, extend above the supportive surface of the supportive housing, and may be drivenly engaged with the drive means such that the passive game pieces rotate about the shaft above the support surface. In this embodiment, the passive game pieces rotate in a plane above that of the housing support surface. The shaft extending above the surface of the supportive housing may, for example, rotate a passive game piece formed in the shape of a windmill. In another embodiment, the shaft rotates a wheel positioned, for example, above the participant-interactive game pan.

In the fullest embodiment of the toy of the present invention, the toy includes two participant-interactive game pans supporting game targets, a first group of passive game pieces positioned about a first noninteractive pan and provided with means to vertically translate the first group of passive game pieces during a rotation of the pan, a second group of passive games pieces positioned about a second non-interactive pan and provided with means to vertically translate the second group of passive game pieces during rotation of the pan, a third group of passive games pieces positioned about a third non-interactive pan with the third group of passive game pieces provided with means to allow rotation about their respective longitudinal axes, a fourth group of passive game pieces positioned to rotate in a plane above that of the support surface of the supportive housing, a passive game piece formed to imitate a windmill, and a passive game piece formed in the shape of a wheel and positioned above the participant-interactive game pans. Each of the pans, and the passive game pieces are caused to rotate simultaneously by the drive means.

BRIEF DESCRIPTION OF THE DRAWINGS

The present invention will be better understood when read in light of the accompanying drawings in which.

DESCRIPTION OF THE PREFERRED EMBODIMENT

Figure 1:
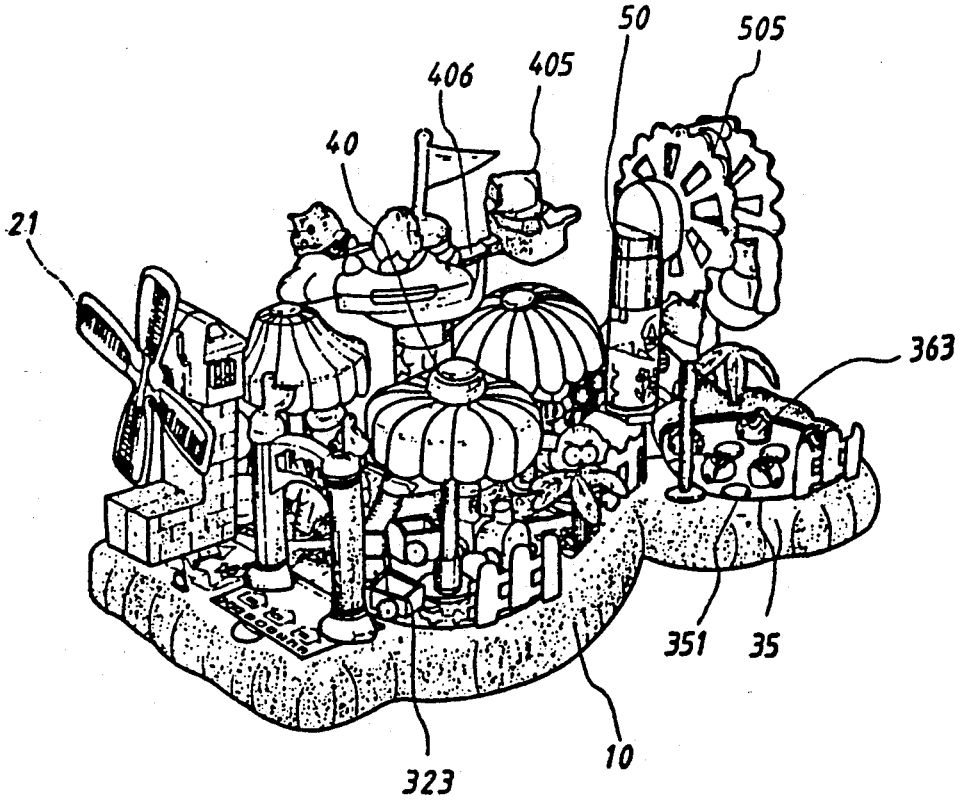
FIG. 1 is a perspective view of the preferred embodiment of the toy of the present invention.
Figure 2:
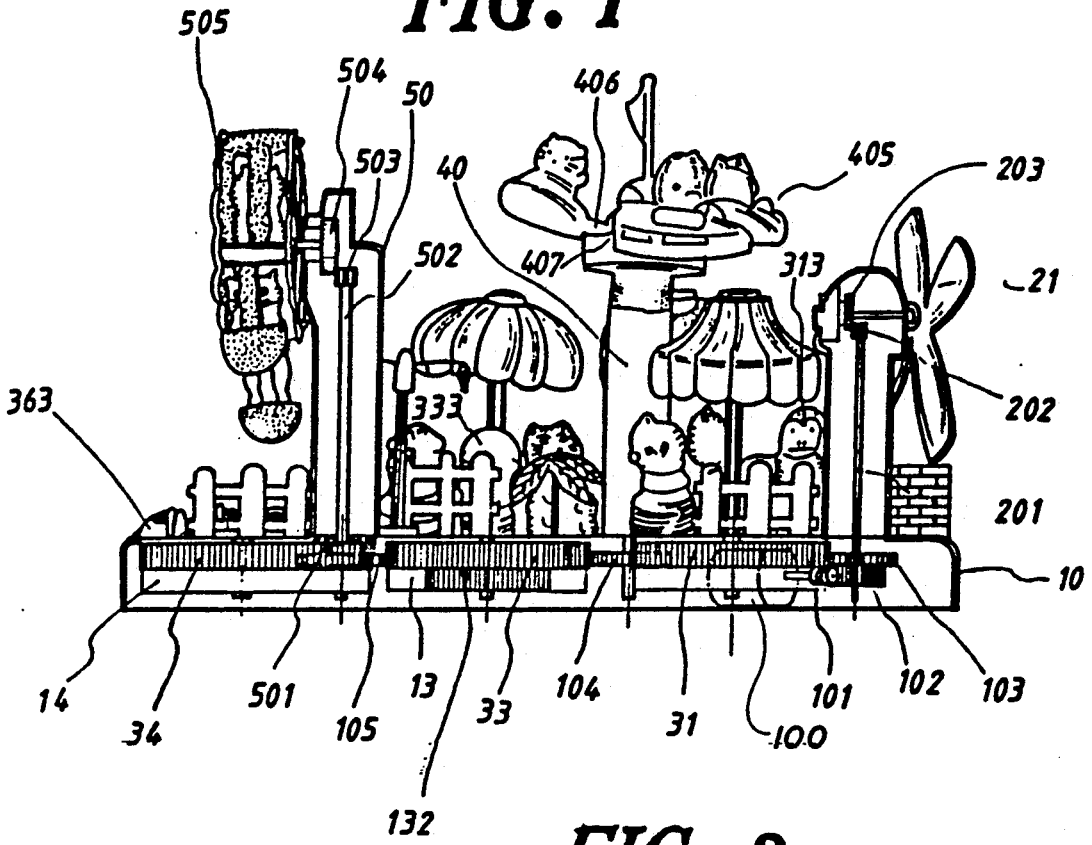
FIG. 2 is a longitudinal sectional view of the toy of FIG. 1.
Figure 3:
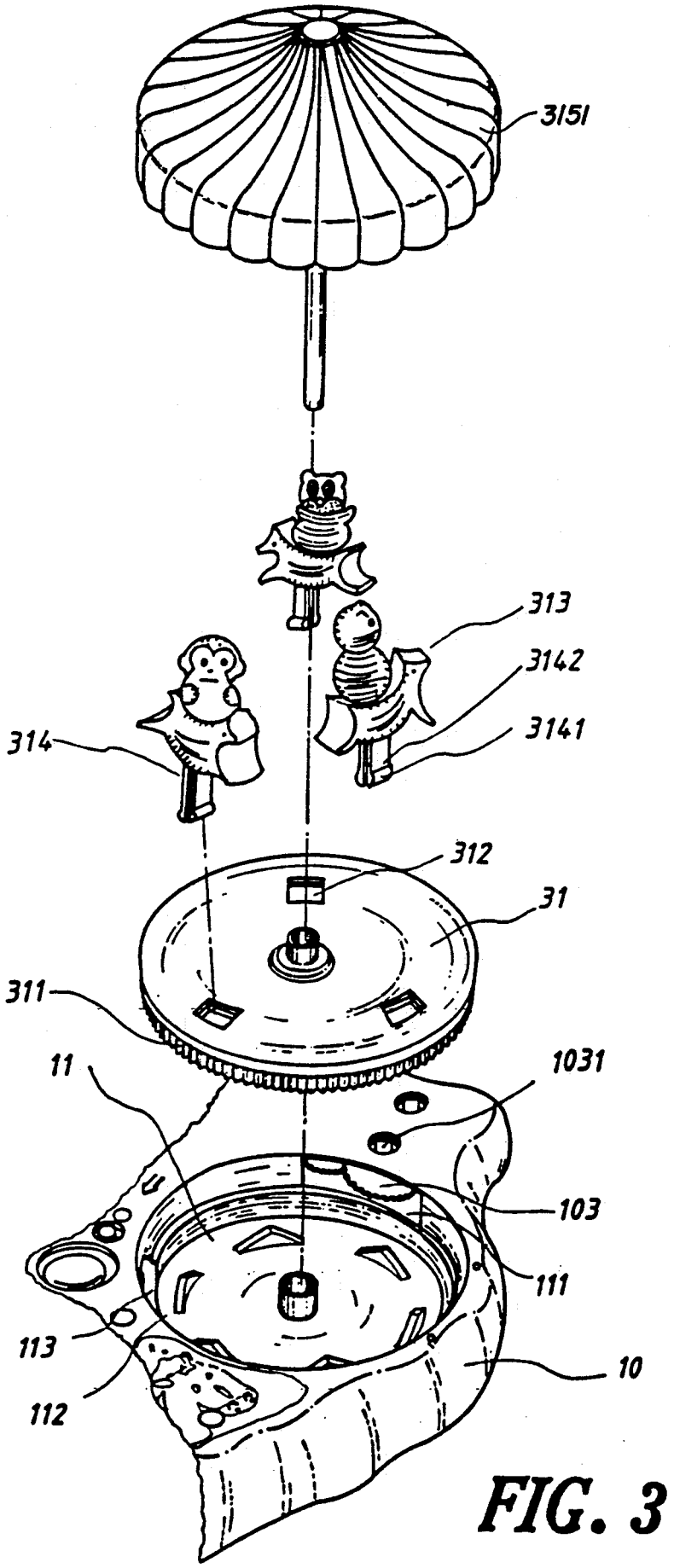
FIG. 3 is an exploded view of a first group of passive game pieces supported for rotation about an axis of a shaft on a rotatable pan.
Figure 4:
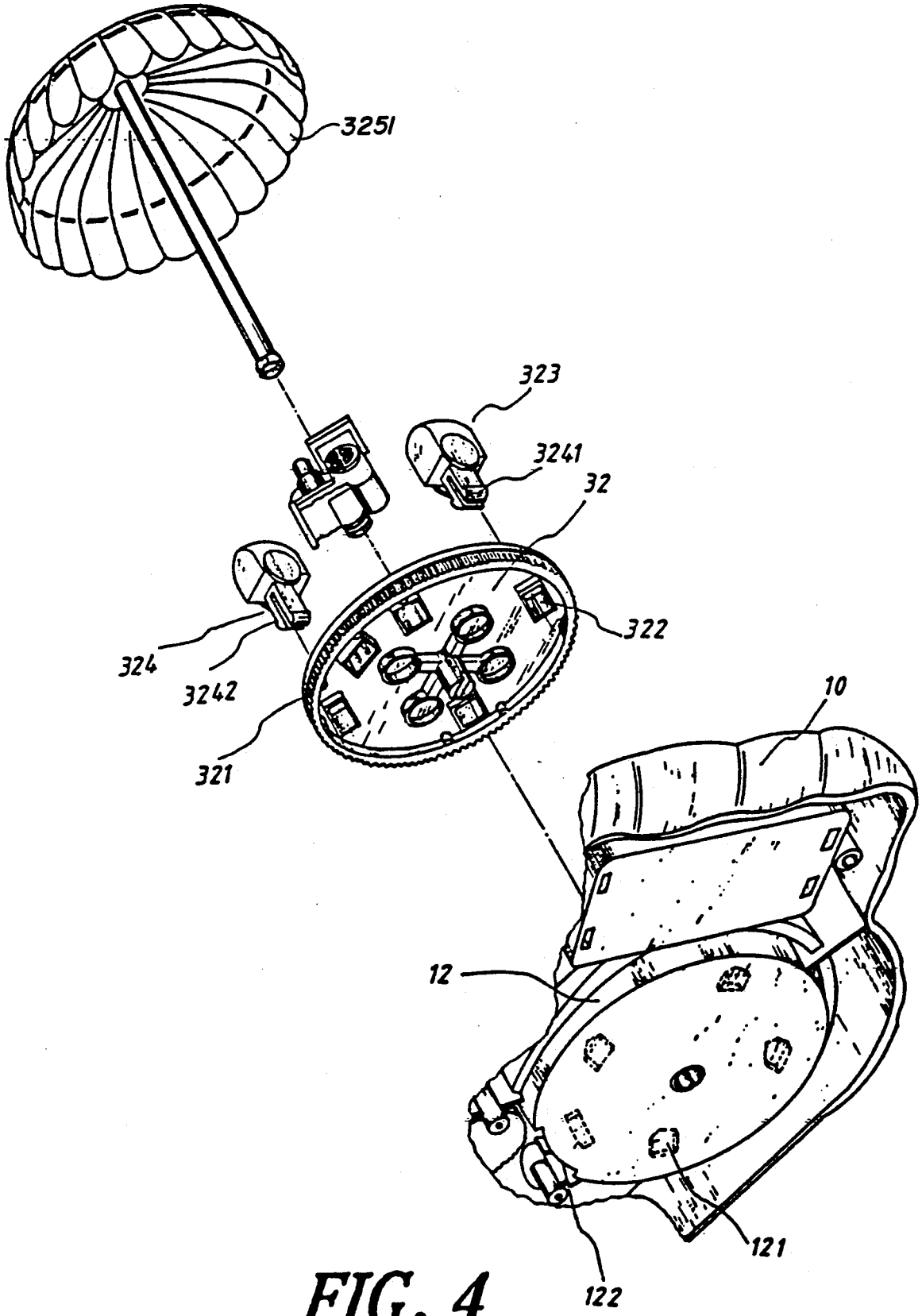
FIG. 4 is an exploded view of a second group of passive game pieces supported for rotation about an axis of a shaft on a rotatable pan.
Figure 5:
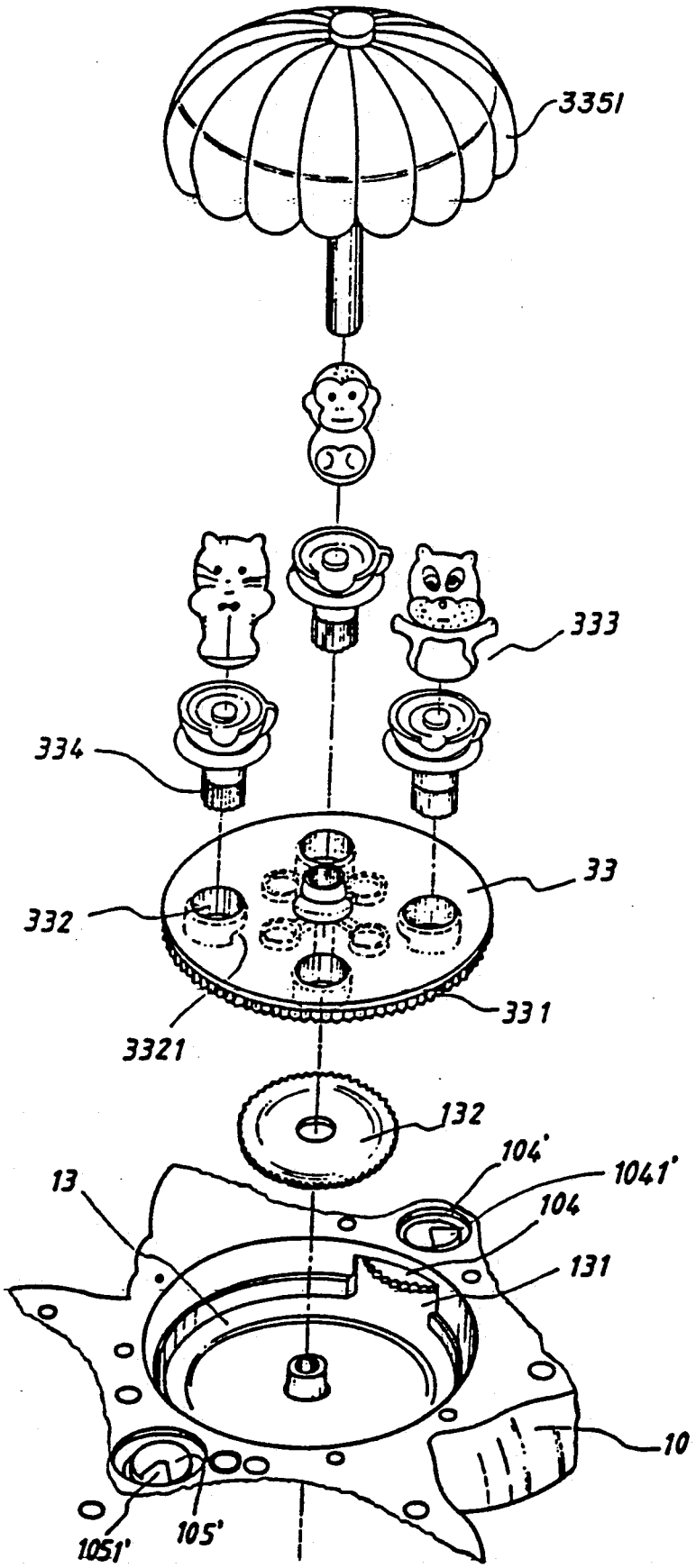
FIG. 5 is an exploded view of a third group of passive game pieces supported for rotation about an axis of a shaft upon a rotatable pan.
Figure 6:
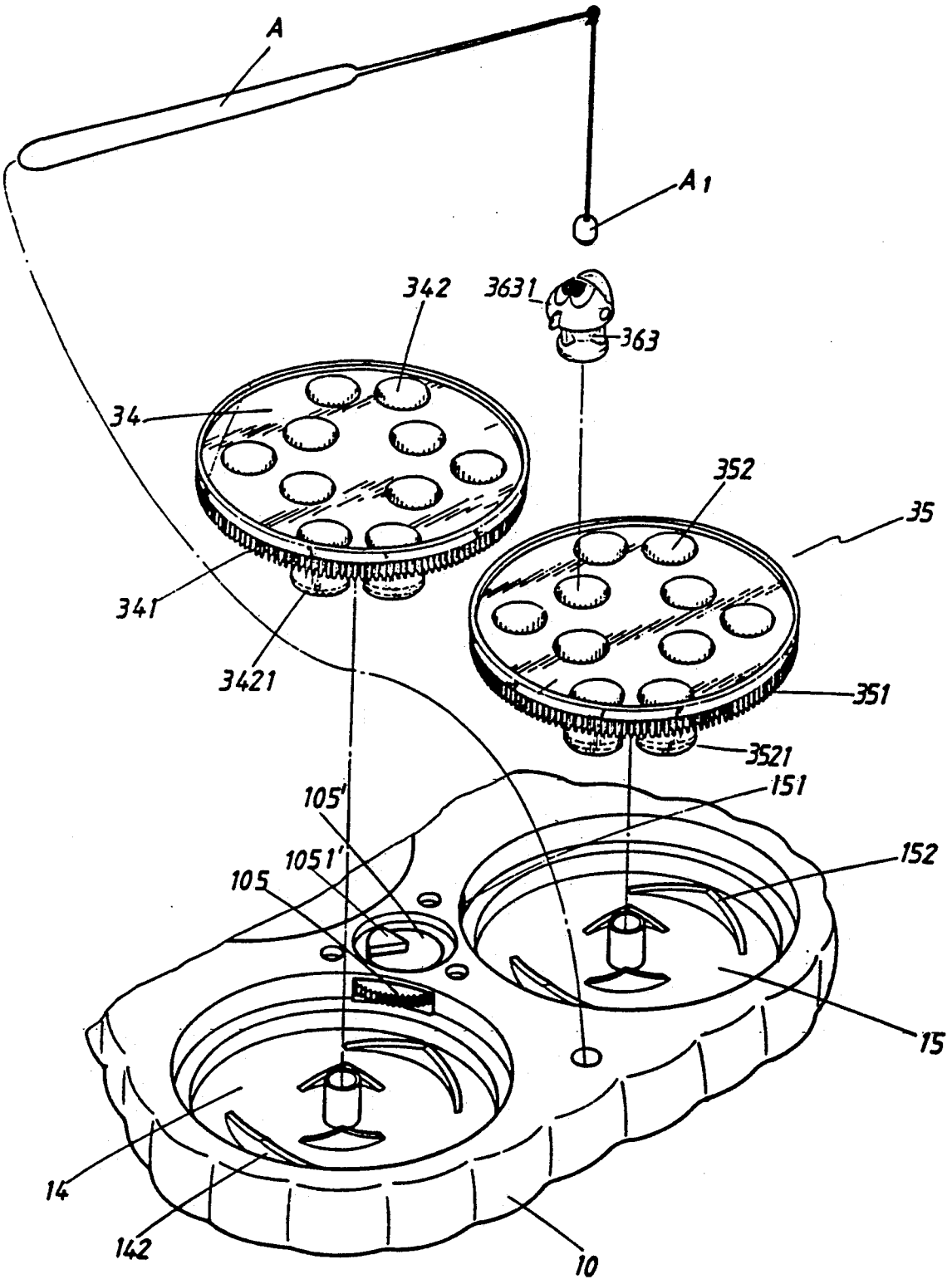
FIG. 6 is an exploded view of two participant-interactive game pans supported for rotation upon the supportive housing, each participant-interactive game pan containing a plurality of vertically extending slots to allow game targets to be positioned therewithin.

Referring now to FIGS. 1–7 there is illustrated the toy of the present invention. The toy includes a supportive housing 10 which supports the various portions of the toy of the present invention. In the preferred embodiment, supportive housing includes five indentations, or cavities 11, 12, 13, 14, and 15 formed on a top support surface of the supportive housing 10. First circular cavity 11 supports first rotating pan 31, second circular cavity 12 supports second rotating pan 32, third circular cavity 13 supports third rotating pan 33, fourth circular cavity 14 supports fourth rotating pan 34, and fifth circular cavity 15 supports fifth rotating pan 35 therewithin. FIG. 3 illustrates an exploded view of the relationship between first rotating pan 31 and cavity 11, FIG. 4 is an exploded view illustrating the relationship between second circular cavity 12 and second rotating pan 32, FIG. 5 similarly illustrates the relationship between third circular cavity 13 and third rotating pan 33, and FIG. 6 illustrates the relationship between circular cavities 14 and 15 with fourth and fifth rotating pans 34 and 35.

As best illustrated in FIG. 3, rotating pan 31 contains peripheral teeth 311 formed on an annular peripheral surface thereof and contains a plurality of vertically extending rectangular sockets 312 (three sockets 312 are illustrated in the Figure) extending through pan 31. Formed on housing 10 on a surface defining cavity 11, and aligned with the rectangular sockets 312 are a plurality of upwardly projecting members 112. Rectangular sockets 312 are of dimensions suitable to allow insertion therein of engaging portions 314 of a first group of passive game pieces 313. The engaging portion 314 of each passive game piece 313 is comprised of an enlarged end portion 3141 and shank portion 3142. The enlarged end portions 3141 engage with upwardly projecting members 112 during operation of the toy of the present invention, as will be more fully described hereinbelow. Further illustrated in the exploded view of FIG. 3 is gear 103 which extends through slot 111 formed in a side wall of the housing 10 forming the cavity 11. Similarly, slot 113 is formed in a side wall of the housing 10 forming the cavity 11. Gear 104 extends through slot 113. Gear 103 meshingly engages with the peripheral teeth 311 of the rotating pan 31. As illustrated, canopy 3151 is further supported to project upwardly from the rotating pan 31. Also illustrated in FIG. 3 is aperture 1031 to allow connecting rod 201 (illustrated in FIG. 2) to extend therethrough.

Referring now to the exploded view of FIG. 4, the relationship between circular cavity 12 and rotating pan 32 is more clearly illustrated. Similar to rotating pan 31, rotating pan 32 has formed about an annular peripheral portion thereof teeth members 321, and a plurality of rectangular sockets 322 extending through the pan 32. Formed to extend upwardly from the portion of supportive housing 10 forming cavity 12 are a plurality of upwardly projecting members 121. Upwardly projecting members 121 are aligned to correspond with the rectangular sockets 322 of the pan 32. A second group of passive game pieces 323 are positioned such that engaging portions 324 extend through the rectangular sockets 322. The engaging portion 324 of each passive game piece 323 is comprised of an enlarged end portion 3241 and shank portion 3242. During operation of the toy of the present invention, the enlarged end portions 3241 of the passive game pieces 323 engage with upwardly projecting members 121. Also illustrated in FIG. 4 is slot 122 and canopy member 3251, with canopy member 3251 being supported to project upwardly from the rotating pan 32.

The relationship between circular cavity 13 of the supportive housing 10 and rotating pan 33 is best illustrated in the exploded view of FIG. 5. The annular peripheral surface of rotating pan 33 has formed thereon a plurality of peripheral teeth 331, and pan 33 contains a plurality of cylindrical, vertically extending sockets 332. Bottom portions of each of the cylindrical sockets 32 contain indentations 3321. A third group of passive game pieces 333 are supported by insertion of end portions thereof through the cylindrical sockets 332. The end portions of each of the third group of passive game pieces 333 have formed therearound cylindrical gears 334. The cylindrical gears 334 of each of the passive game pieces 333 meshingly engage with sun gear 132. Also illustrated in FIG. 5 is gear 104 which extends through slot 131 formed on a side wall of the housing 10 forming cavity 13. Gear 104 meshingly engages with the peripheral teeth members 331 formed about the annular peripheral surface of rotating pan 33. Again, a canopy member 3351 is positioned to project upwardly from the surface of rotating pan 33.

Referring now to the exploded view of FIG. 6, there is illustrated the relationship between circular cavity 14 of supportive housing 10 and rotating pan 34, and the relationship between circular cavity 15 of supportive housing 10 and rotating pan 35. Rotating pans 34 and 35 represent the participant-interactive game portion of the toy of the present invention. Pans 34 and 35 have formed on annular peripheral portions thereof teeth members 341 and 351, respectively, and pans 34 and 35 contain a plurality of vertically extending circular sockets 342 and 352, respectively having arcuate grooves 3421 and 3521 extending therethrough. Formed on the surface of portions of supportive housing 10 forming the cavities 14 and 15 are a plurality of upwardly projecting members 142 and 152, respectively. Upwardly projecting members 142 and 152 are aligned with the arcuate grooves 3421 and 3521 formed in sockets 342 and 352 of pans 34 and 35. A plurality game targets 363, here shown to be formed in the shape of fish, are positioned in the sockets 342 and 352. During rotation of the pans 34 and 35, the upwardly projecting members 142 and 152 pass through the arcuate grooves 3421 and 3521 of sockets 342 and 352 to contact bottom portions of the game targets 363 to thereby raise and lower the game targets 363 positioned within the sockets 342 and 352. Game targets 363 further have a portion formed to imitate a mouth 3631 of a fish. Gear 105 extends through a second slot 133 formed in the side wall of cavity 13 and, like gear 104, meshingly engages with the peripheral teeth members 131 of rotating pan 33. Gear 105 furthermore extends through a slot 1141 in a sidewall of cavity 14 and a slot 151 in a sidewall of cavity 15 to meshingly engages with the peripheral teeth 341 and 351 of the rotating pans 34 and 35, respectively. Also illustrated in FIG. 6 is fishing rod A having magnet A1 supported at an end portion thereof. During operation of the toy of the present invention, game participants use fishing rod A to attempt to catch game targets 363 positioned in the sockets 342 and 352.

Figure 7:
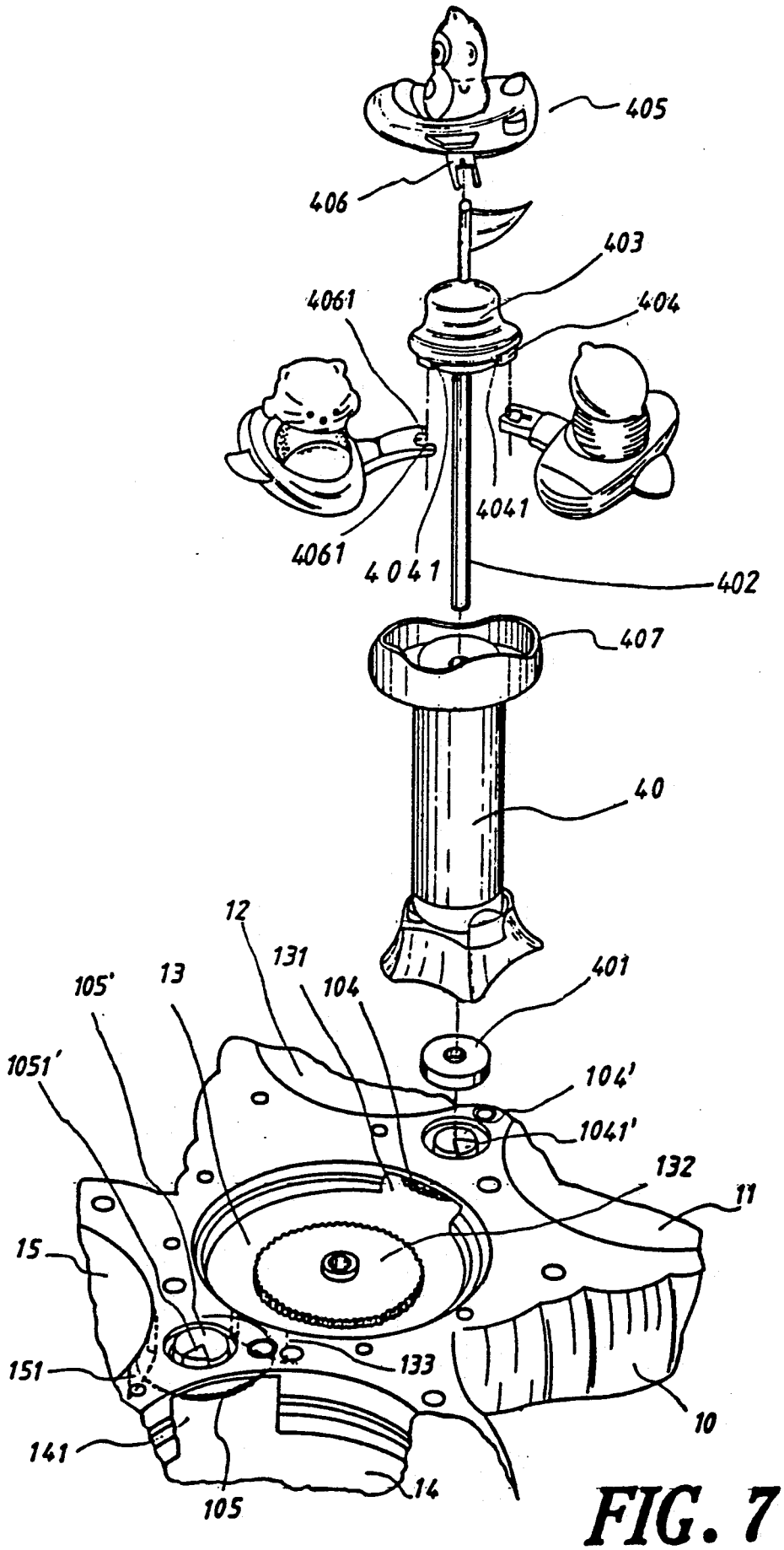
FIG. 7 is an exploded view of a fourth group of passive game elements supported for rotation about an axis of a shaft wherein the shaft extends above the support surface of the supportive housing.

Referring now to the exploded view of FIG. 7, there is illustrated a further portion of the toy of the preferred embodiment of the present invention. Rotating plate 401 is positioned for rotation on an indention formed on supportive housing 10. Extending upwardly from rotating plate 401 is first connecting rod 402. Positioned about the connecting rod 402 for aesthetic purposes is housing assembly 40. Affixed at a top portion of connecting rod 402 is connector 403. Connector 403 has means forming lugs 404 formed on annular surface portions thereof, the lugs 404 having undercut slots 4041 to allow insertion therewithin of hooked end portions 4061 of engaging means 406 of a fourth group of passive game pieces 405. Housing assembly 40 further contains a wavy top portion 407. Rotation of connecting rod 402, thereby, causes rotation of passive game pieces 405 and portion 407 causes game pieces 405 to vertically translate during rotation thereof.

Also illustrated in FIG. 7 are gears 104 and 105. Secured to the respective gears 104 and 105 are transmitting pieces 104' and 105' which are connected to engaging pieces 1041' and 1051', respectively. Attached to pieces 1041' and 1051' are engaging pieces (not shown) of rotating plates 401 and 501, respectively, to allow coaxial mounting thereto of connecting rods 402 and 502 housed in housing 40 and 50.

Referring now to the longitudinal, sectional view of FIG. 2, there is shown the meshing relationship between the various portions of the toy of the present invention to allow simultaneous rotation of the individual pans during operation of the toy. Also illustrated in FIG. 2 is windmill 21 projecting above the surface of supportive housing 10 and drivenly engaged with connecting rod 201 having gear 202 positioned at a top end portion thereof. Gear 202 engages with gear 203. Similarly, connecting rod 502 projects above the surface of supportive housing 10 wherein connecting rod 502 has affixed at an end portion thereof gear 503. In the preferred embodiment, connecting rod 502 is surrounded by housing 50. Gear 503 meshingly engages with gear 504. Wheel 505 rotates responsive to rotation of connecting rod 502. In this preferred embodiment, wheel 505 is positioned above the participant-interactive rotating game pans 34 and 35. The driving force for causing rotation to pans 31–35 is supplied by drive motor 100. Drive motor 100 is supported in the supportive housing 10 of the toy, and has a rotating shaft having worm gear 101 which meshingly engages with worm gear 102. Worm gear 102 and gear 103 are maintained in a coaxial relationship wherein rotation worm gear 102 also causes rotation of gear 103. In the preferred embodiment, connecting rod 201 is also caused to rotate responsive to rotation of gears 102 and 103. As illustrated in the sectional view of FIG. 2, as well as the exploded view of FIG. 3, gear 103 meshingly engages with the annular peripheral teeth 311 formed on the annular peripheral surface of rotating pan 31. Central gear 104 is positioned to meshingly engage with not only teeth 311 of rotating pan 31, but also with the annular peripheral teeth 331 formed on the annular peripheral surface of rotating pan 33 and the annular peripheral teeth 321 formed on the annular peripheral surface of rotating pan 32. This relationship is illustrated in both the sectional view of FIG. 2 and also the exploded view of FIG. 5. Sun gear 132 is positioned in a coaxial relationship with the pan 33 such that the rotation of pan 33 also causes rotation of gear 132. As described previously, sun gear 132 meshingly engages with cylindrical gears 334 positioned at end portions of a second group of passive game pieces 333 such that rotation of gear 132 causes rotation of the passive game pieces 333 about their respective axes. Gear 105 is positioned to meshingly engage with not only the annular peripheral teeth 331 of pan 33, but also the annular peripheral teeth 341 formed on the annular peripheral surface of rotating pan 34 and the annular peripheral teeth 351 formed on the annular peripheral surface of rotating pan 35. In the preferred embodiment of FIG. 2, connecting rod 502 projecting upwardly from the supportive housing 10 is also caused to rotate responsive to rotation of gear 105 and rotating plate 501. When configured as such, operation of drive motor 100 causes rotation of windmill 21, rotation of rotating pan 31 having the first group of passive game pieces thereupon, rotation of the forth group of passive game pieces 406, rotation of the third group of passive game pieces 333, rotation of wheel 505, and rotation of participant-interactive game pans 34 and 35. Additionally, each of the passive game pieces 333 rotate about their respective axis. Additionally, passive game pieces 323 of the second group of passive game pieces are caused to rotate upon pan 32, and the individual game pieces 323 and 313 are caused vertical translation due to upwardly projecting members 112 and 121 formed to project upwardly from supportive housing 10.

Referring again to the exploded view of FIG. 6, when drive motor 100 causes rotation of the rotating pans 34 and 35, through their meshing engagement with gear 105, the game targets 363 positioned in the sockets 342 and 352 are caused to rotate responsive to rotation of pans 34 and 35, and also to translate up and down in the vertical direction because of contact with upwardly projecting members 142 and 152 formed on the surface of cavities 14 and 15 which pass through arcuate slots 3421 and 3521 of sockets 342 and 352 described previously. One or more game participants holding fishing rod A attempts to catch the game targets 363. Wheel 505 which also rotates during rotation of pans 34 and 35 acts to impede the access of the game participants to the game targets, thereby increasing the skill required to catch the game targets 363. Because the toy of the present invention provides not only a participant-interactive game portion comprised of rotating pans 34 and 35 allowing the game participants to participate in a fishing game, but also further provides a visually enjoyable portion comprised of groups of passive game pieces, the toy of the present invention is of increased entertainment value.

While the present invention has been described in accordance with the preferred embodiments of the various figures, it is to be understood that other similar embodiments may be used or modifications and additions may be made to the described embodiment for preforming the same functions of the present invention without the deviating therefrom. Therefore, the present invention should not be limited to any single embodiment, but rather construed in breath and scope in accordance with the recitation of the appended claims.

I claim:

1. A toy having a participant-interactive game portion for active participation by game participants, and a noninteractive portion for visually entertaining said game participants, said toy including:

a supportive housing having a plurality of cavities;

of least one participant-interactive game pan having a plurality of vertically extending sockets and supported for rotation in a cavity of the plurality of cavities, said at least one participant-interactive game pan including a plurality of game targets positioned in individual sockets of the plurality of vertically extending sockets for access thereto by said game participants;

at least one noninteractive pan having a plurality of vertically extending sockets and supported for rotation in a cavity of the plurality of cavities for visually entertaining said game participants, each of said at least one noninteractive pan including a plurality of passive game pieces positioned for support in individual sockets thereof, a first one of said at least one noninteractive pan being operably connected to a sun gear positioned therebeneath whereby rotation of said first one of said at least one noninteractive pan causes rotation of said sun gear, and each of said plurality of passive game pieces positioned for support in said first one of said at least one noninteractive pan has a cylindrical gear formed on a bottom portion thereof for meshingly engaging with the sun gear such that rotation of the sun gear causes rotation of each of the plurality of passive game pieces; and drive means including a motor and gear means for simultaneously rotating said at least one participant-interactive game pan and said at least one noninteractive pan.

2. The toy of claim 1 further including first means associated with the supported housing for displacing individual ones of the plurality of game targets in the sockets of said at least one participant-interactive game pan upon rotation thereof.

3. The toy of claim 2 wherein said first means associated with the supportive housing for displacing includes wedge-shaped tracks for causing the game targets to rise and fall in the sockets of said at least one participant-interactive game pan during rotation thereof.

4. The toy of claim 2 further including second means associated with the supportive housing for displacing individual ones of the plurality of passive game pieces positioned in the sockets of a second one of said at least one noninteractive pan during rotation thereof.

5. The toy of claim 4 wherein said second means associated with the supportive housing for displacing includes wedge-shaped tracks for causing the passive game pieces to rise and fall in the sockets of said second one of said at least one noninteractive pan during rotation thereof.

6. The toy of claim 1 wherein said gear means engage with peripheral teeth formed on an annular peripheral surface of said at least one participant-interactive game pan.

7. The toy of claim 6 wherein said gear means further engage with peripheral teeth formed on an annular peripheral surface of said at least one noninteractive pan.

8. The toy of claim 1 further including a shaft extending above the supportive housing which is caused to rotate with rotation of the gear means.

9. The toy of claim 8 wherein at least one passive game piece rotates about the shaft above said supportive housing.

10. The toy of claim 9 wherein said shaft extending above the supportive housing rotates a passive game piece formed in the shape of a windmill.

11. The toy of claim 9 wherein said shaft extending above the supportive housing rotates a passive game piece formed in the shape of a wheel.

12. The toy of claim 11 wherein said wheel is positioned above said at least one participant-interactive game pan.

13. A diversified toy comprising:

a first housing having five cavities respectively formed therein for rotatably supporting five peripherally toothed disks;

a drive motor contained within said housing;

a drive gear driven by said drive motor and rotatably mounted in said housing, said drive gear meshing with a first one of said disks;

a first central gear rotatably mounted in said housing and centrally positioned among and meshing with said first one, a second one and a third one of said disks, said first disk being provided with a first plurality of through-holes, said second disk being provided with a second plurality of through-holes and said third disk being provided with a third plurality of through-holes;

a first plurality of actuating pieces respectively provided on bottom walls of a first one and a second one of said five cavities;

a first plurality of driven pieces respectively passing through said first and second pluralities of through holes for engaging with said first plurality of actuating pieces in a manner that said first plurality of driven pieces are vertically movable when said first and second disks are rotated;

a sun gear arranged adjacent a bottom wall of a third one of said five cavities and being rotatable with said third disk;

a second plurality of driven pieces respectively passing through said third plurality of through-holes, each of said second plurality of driven pieces having a cylindrical gear formed on a bottom portion thereof for meshing with said sun gear;

a second central gear rotatably mounted in said housing and centrally positioned among and meshing with said third one, a fourth one and a fifth one of said five disks, in which said fourth and fifth disks respectively include a plurality of receiving sockets respectively having thereunder a plurality of arcuate grooves;

a second plurality of actuating pieces respectively provided on bottom walls of a fourth one and a fifth one of said five cavities and capable of respectively passing through said arcuate grooves;

an upwardly extending connecting rod having a first end coaxially secured to said first central gear and a second end secured to a connector, said connector supporting a third plurality of driven pieces; and a second housing fixed on said first housing about said connecting rod and having a wavy top portion along which said third plurality of driven pieces are guided to vertically oscillate when said connecting rod is rotated.

* * * * *